US007573196B2

(12) United States Patent
Kwon et al.

(10) Patent No.: US 7,573,196 B2
(45) Date of Patent: Aug. 11, 2009

(54) PLASMA DISPLAY PANEL HAVING ELECTRODES WITH EXPANSION PORTIONS

(75) Inventors: Jae-Ik Kwon, Suwon-si (KR); Sung-Ho Song, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 611 days.

(21) Appl. No.: 11/135,388

(22) Filed: May 24, 2005

(65) Prior Publication Data

US 2005/0264199 A1 Dec. 1, 2005

(30) Foreign Application Priority Data

May 25, 2004 (KR) ..... 10-2004-0037356

(51) Int. Cl.
*H01J 17/49* (2006.01)
*H05B 37/00* (2006.01)
*H05B 39/00* (2006.01)

(52) U.S. Cl. ..... 313/582; 313/583; 313/587; 315/169.1; 315/169.3

(58) Field of Classification Search ..... 313/582–583
See application file for complete search history.

(56) References Cited

U.S. PATENT DOCUMENTS

| | | | | |
|---|---|---|---|---|
| 5,838,105 | A * | 11/1998 | Mitomo | 313/582 |
| 6,469,441 | B1 * | 10/2002 | Choi | 313/583 |
| 7,045,962 | B1 * | 5/2006 | Murai et al. | 313/582 |
| 2002/0089285 | A1 * | 7/2002 | Nishiki et al. | 313/583 |
| 2005/0146273 | A1 * | 7/2005 | Wu et al. | 313/584 |

FOREIGN PATENT DOCUMENTS

| | | |
|---|---|---|
| JP | 06103902 | 4/1994 |
| JP | 2001023529 | 1/2001 |
| JP | 2001084908 | 3/2001 |

* cited by examiner

*Primary Examiner*—Sikha Roy
*Assistant Examiner*—Tracie Y Green
(74) *Attorney, Agent, or Firm*—H. C. Park & Associates, PLC

(57) ABSTRACT

A plasma display panel including an upper substrate, a lower substrate coupled to the upper substrate to form a display area for displaying an image and a terminal area, and a plurality of electrodes respectively including a discharge portion disposed in the display area, a terminal portion disposed in the terminal area, a connection portion coupling the discharge portion and the terminal portion, and an expansion portion. The expansion portion is formed at at least one of a juncture of the connection portion and the discharge portion or a juncture of the connection portion and the terminal portion.

16 Claims, 7 Drawing Sheets

PLASMA DISPLAY PANEL HAVING ELECTRODES WITH EXPANSION PORTIONS

CROSS REFERENCE TO RELATED APPLICATION

This application claims priority to and the benefit of Korean Patent Application No. 10-2004-0037356, filed on May 25, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP having an improved electrode structure that may permit the electrode to more firmly adhere to a substrate.

2. Discussion of the Background

Generally, applying a discharge voltage to a pair of PDP sustain electrodes generates a gas discharge, which emits ultraviolet rays. The ultraviolet rays excite a fluorescent layer, which emits visible light that forms an image.

FIG. 1 shows a conventional PDP.

Referring to FIG. 1, the PDP 10 includes an upper substrate 11 facing a lower substrate 21. The substrates are substantially parallel to each other.

Pairs of sustain electrodes 31 comprising an X electrode 32 and a Y electrode 35 separated from each other by a discharge gap, may be formed on a lower surface of the upper substrate 11. The X electrode 32 may act as a common electrode, and the Y electrode 35 may act as a scan electrode.

The X and Y electrodes 32 and 35 may include transparent electrodes 33 and 36 and bus electrodes 34 and 37, respectively. The bus electrodes 34 and 37 may be formed along edges of the transparent electrodes 33 and 36 to apply voltages to the transparent electrodes 33 and 36. An upper dielectric layer 12 covers the pairs of sustain electrodes 31, and a protective layer 13 covers the upper dielectric layer 12.

Address electrodes 22 may be formed on the lower substrate 21 in a direction substantially orthogonal to the sustain electrode pairs 31. An intersection of an address electrode 22 and a sustain electrode pair 31 corresponds to a sub-pixel.

A lower dielectric layer 23 may cover the address electrodes 22. Stripe-shaped barrier ribs 24 may be formed on an upper surface of the lower dielectric layer 23 to define discharge regions 25. A phosphor layer 26 is formed in the discharge regions 25, and a discharge gas is filled in the discharge regions 25.

The PDP 10 having the above structure may operate as follows.

Applying an address discharge voltage between an address electrode 22 and a Y electrode 35 generates an address discharge in a sub-pixel, thereby forming wall charges in the addressed sub-pixel. Next, applying a sustain discharge voltage between the X electrode 32 and the Y electrode 35 of the addressed sub-pixel generates a sustain discharge. The electric charges generated by the sustain discharge collide with the discharge gas, thereby generating plasma, which emits ultraviolet rays. The ultraviolet rays excite the phosphor layer 26 to emit visible light, thereby displaying an image.

Referring to FIG. 2, the X and Y electrodes 32 and 35 may extend from left and right hand sides of the PDP, and they are alternately arranged in a row direction. The X electrodes 32 extend from the terminal area T to the display area D, and they may be connected to an X electrode driving unit through a connection member (not shown). The Y electrodes 35 extend from the terminal area T to the display area D, and they may be connected to a Y electrode driving unit through a connection member (not shown). Thus, the X and Y electrode driving units may apply voltages to the X and Y electrodes 32 and 35, respectively.

Generally, a plurality of connection members may be connected to the X electrodes 32, but there are fewer connection members than X electrodes 32. Similarly, a plurality of connection members may be connected to the Y electrodes 35, but there are fewer connection members than Y electrodes 35. Accordingly, a plurality of X electrodes 32 may be connected to one connection member, and a plurality of Y electrodes 35 may be connected to one connection member.

In more detail, referring to FIG. 3, terminal portions 34*b* and 37*b* of the bus electrodes 34 and 37 may be connected to the connection members. The pitch between terminal portions 34*b* and 37*b* should be less than the pitch between the bus electrodes' discharge portions 34*a* and 37*a*, to which the transparent electrodes 33 and 36 are connected, to ensure margins that do not generate interference between connection members. Thus, connection portions 34*c* and 37*c* formed between the discharge portions 34*a* and 37*a* and the terminal portions 34*b* and 37*b* may be straight at the connection member's center, but most of the connection portions 34*c* and 37*c* are slanted, as shown in FIG. 3.

Generally, the bus electrodes 34 and 37 may be applied as a paste and then dried and baked. However, the junctures of the slanted connection portions 34*c* and 37*c* and the discharge portions 34*a* and 37*a*, and the junctures of the slanted connection portions 34*c* and 37*c* and the terminal portions 34*b* and 37*b*, are bent. Thus, these junctures may be heated more than any other elements in the baking process, which may occur at more than 400° C. Accordingly, the junctures may lift off of the upper substrate 11. If the junctures lift off too much, they may cause shorts from the connection portions 34*c* and 37*c* or the terminal portions 34*b* and 37*b* of adjacent bus electrodes 34 and 37.

SUMMARY OF THE INVENTION

The present invention provides a PDP having bus electrodes that may more strongly adhere to an upper substrate by forming expansion portions at junctures of a connection portion and a discharge portion and at junctures of the connection portion and a terminal portion.

Additional features of the invention will be set forth in the description which follows, and in part will be apparent from the description, or may be learned by practice of the invention.

The present invention discloses a PDP including an upper substrate, a lower substrate coupled to the upper substrate to form a display area for displaying an image and a terminal area, and a plurality of electrodes. An electrode includes a discharge portion disposed in the display area, a terminal portion disposed in the terminal area, a connection portion coupling the discharge portion with the terminal portion, and an expansion portion. The expansion portion is formed at a juncture of the connection portion and the discharge portion, at a juncture of the connection portion and the terminal portion, or at both junctures.

The present invention also discloses a PDP including a lower substrate, address electrodes formed on an upper surface of the lower substrate and covered by a lower dielectric layer, an upper substrate facing the lower substrate, barrier ribs formed between the lower and upper substrates to define discharge cells forming a display area, and sustain electrodes formed on a lower surface of the upper substrate and extending to cross the address electrodes. A sustain electrode includes a bus electrode having a discharge portion disposed in the display area and covered by an upper dielectric layer, a terminal portion disposed outside of the display area, a connection portion coupling the discharge portion with the terminal portion, and an expansion portion. The expansion portion is formed at a juncture of the connection portion and the discharge portion, at a juncture of the connection portion and the terminal portion, or at both junctures.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
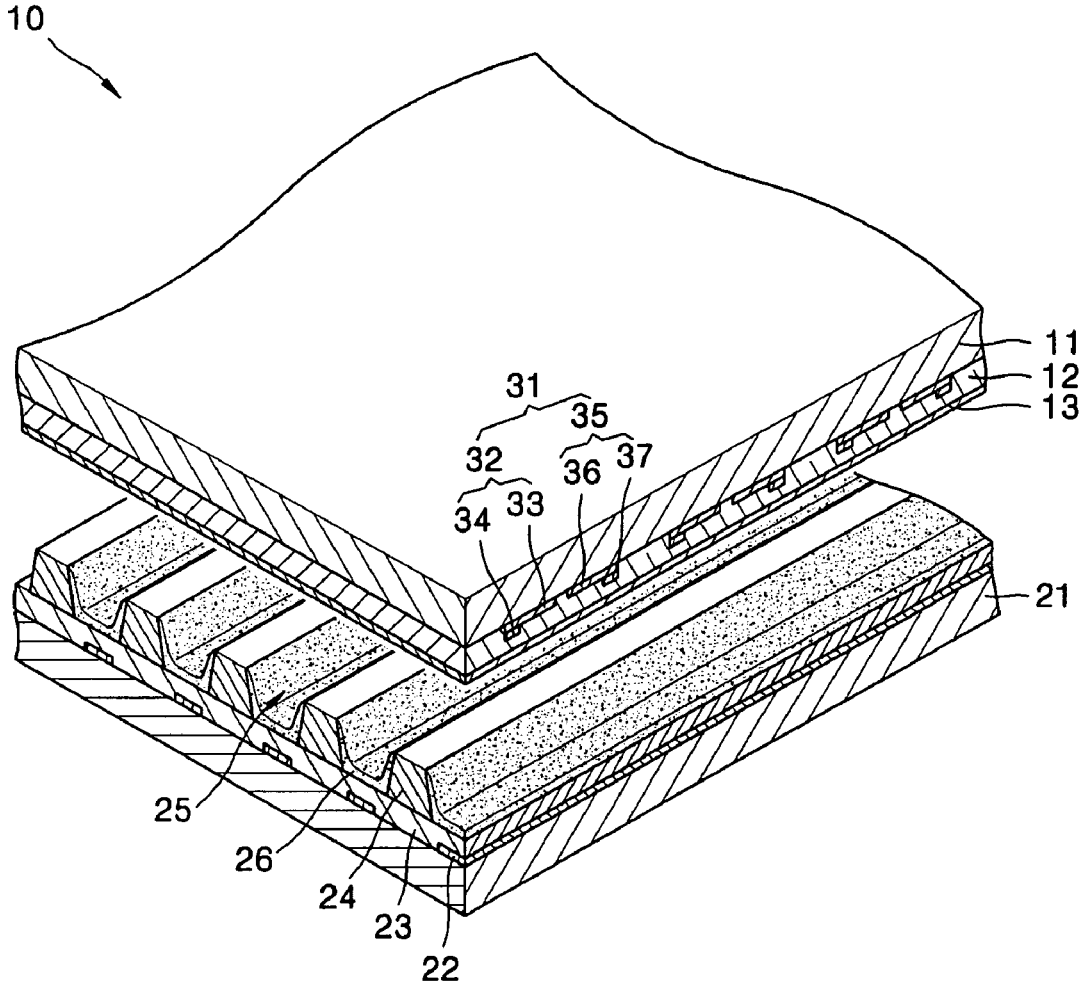
FIG. 1 (PRIOR ART)
FIG. 1 is a partial perspective view showing a conventional PDP.
Figure 2:
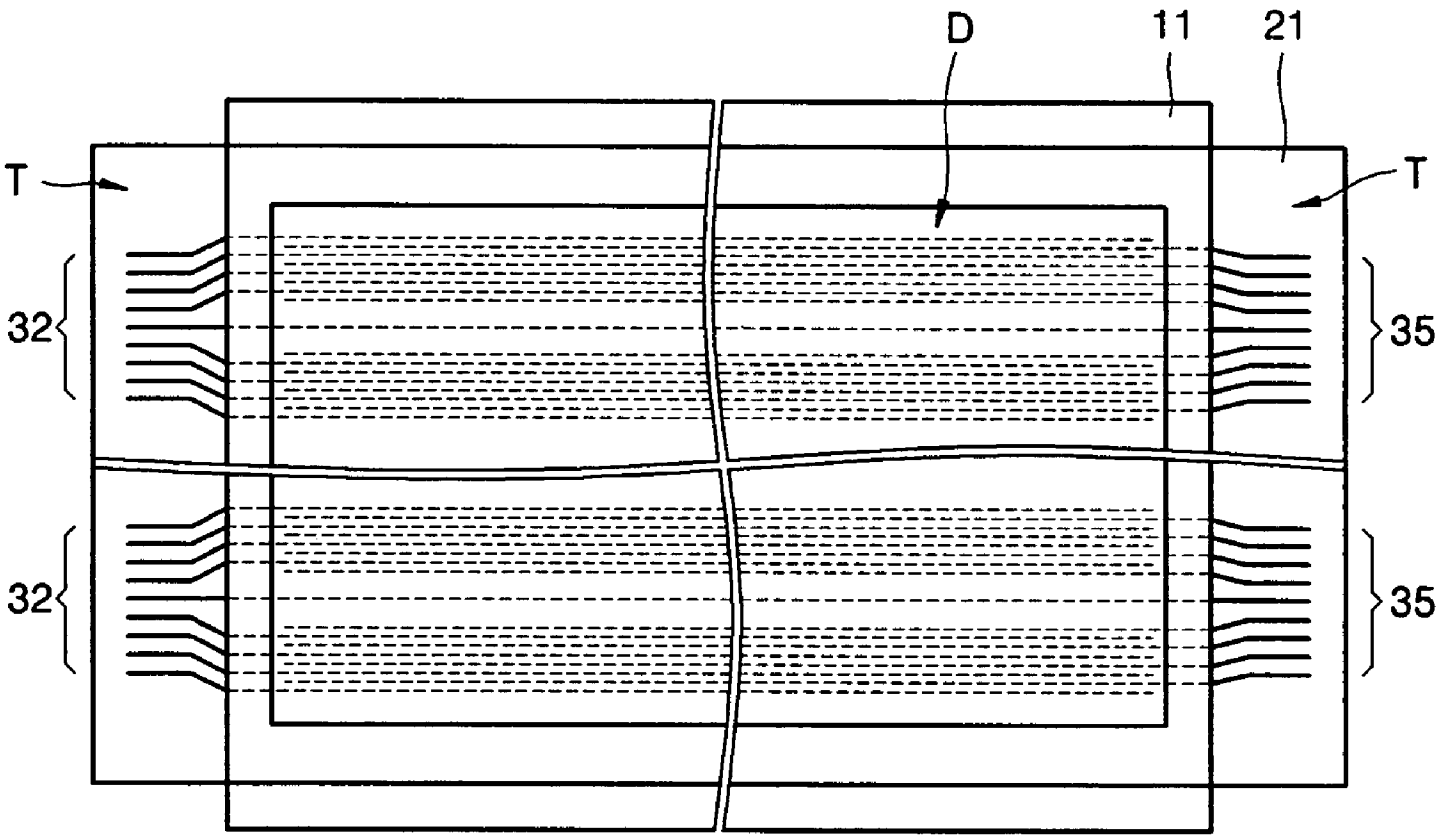
FIG. 2 (PRIOR ART)
FIG. 2 is a plan view showing an arrangement of sustain electrode pairs in PDP of FIG. 1.
Figure 3:
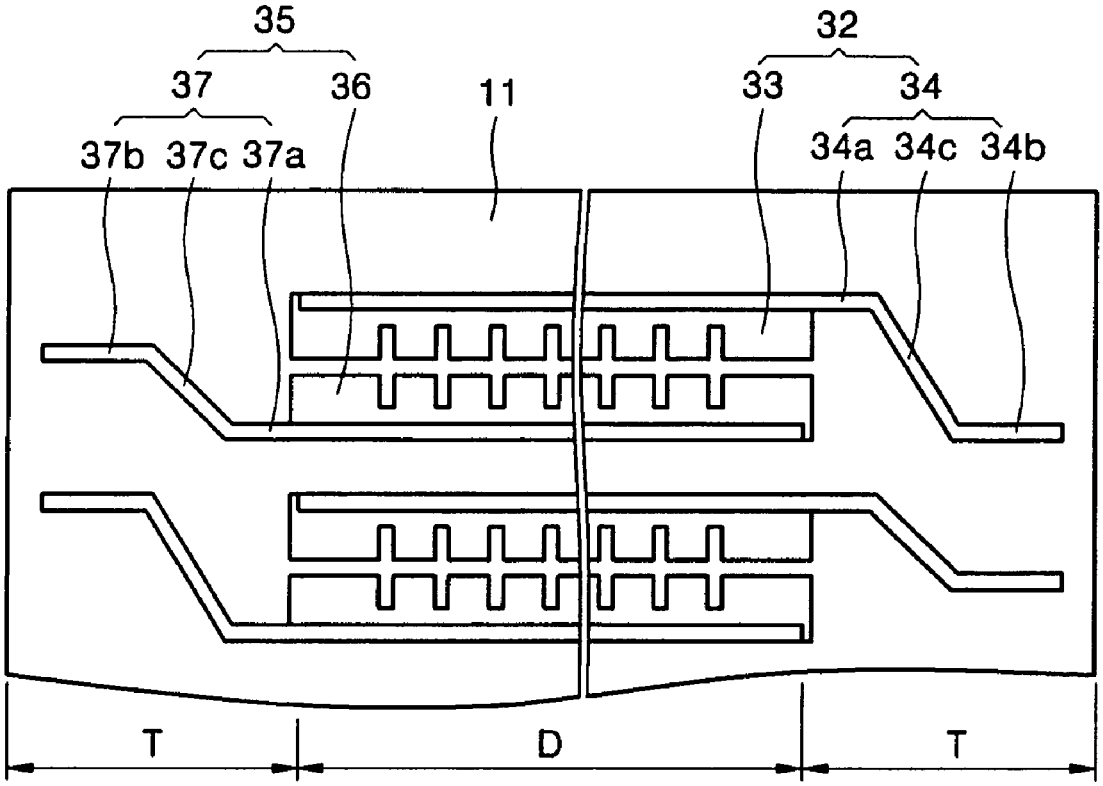
FIG. 3 (PRIOR ART)
FIG. 3 is a plan view showing sustain electrode pairs of FIG. 2.
Figure 4:
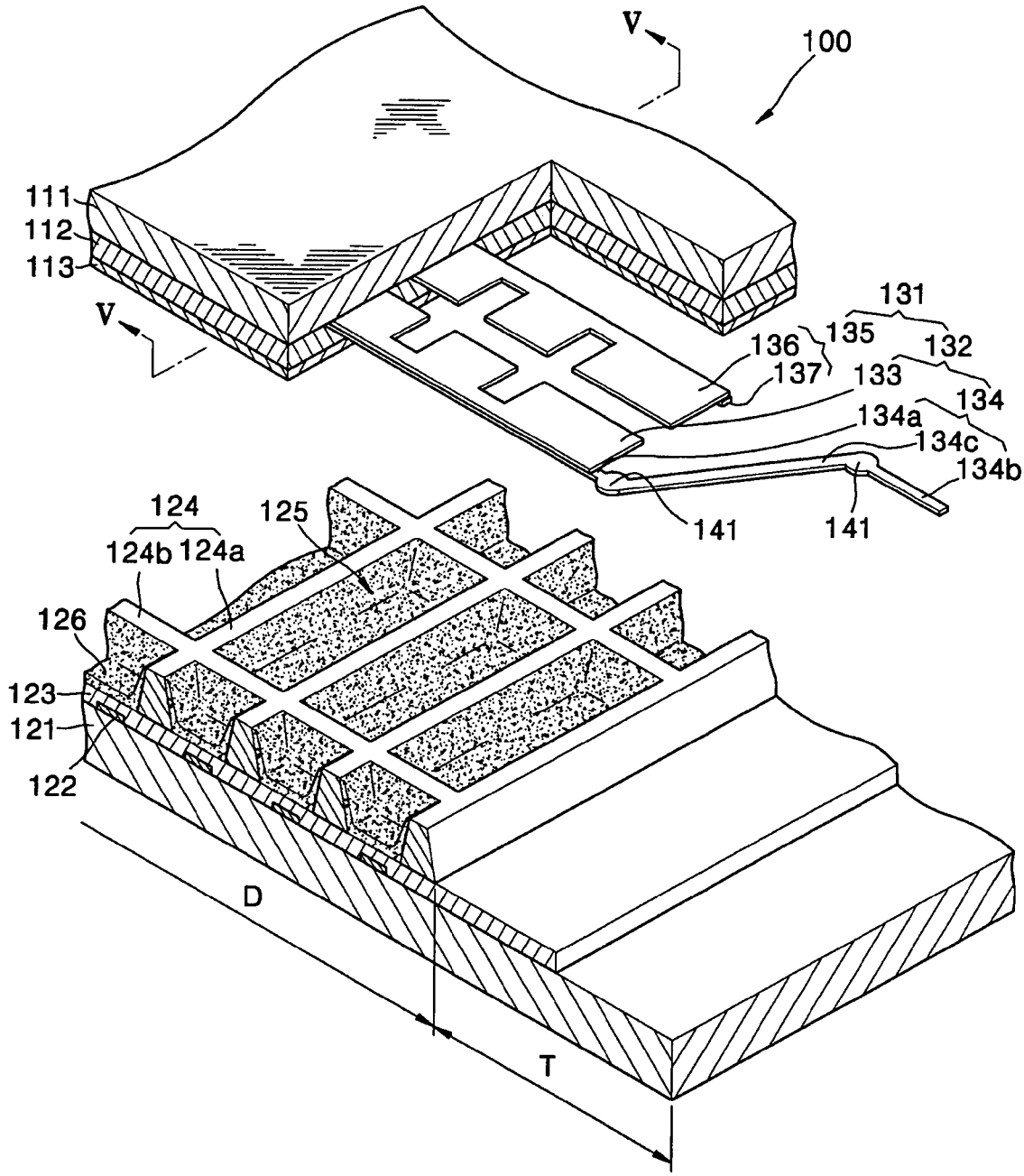
FIG. 4 is a partial perspective view showing a PDP according to an exemplary embodiment of the present invention.
Figure 5:
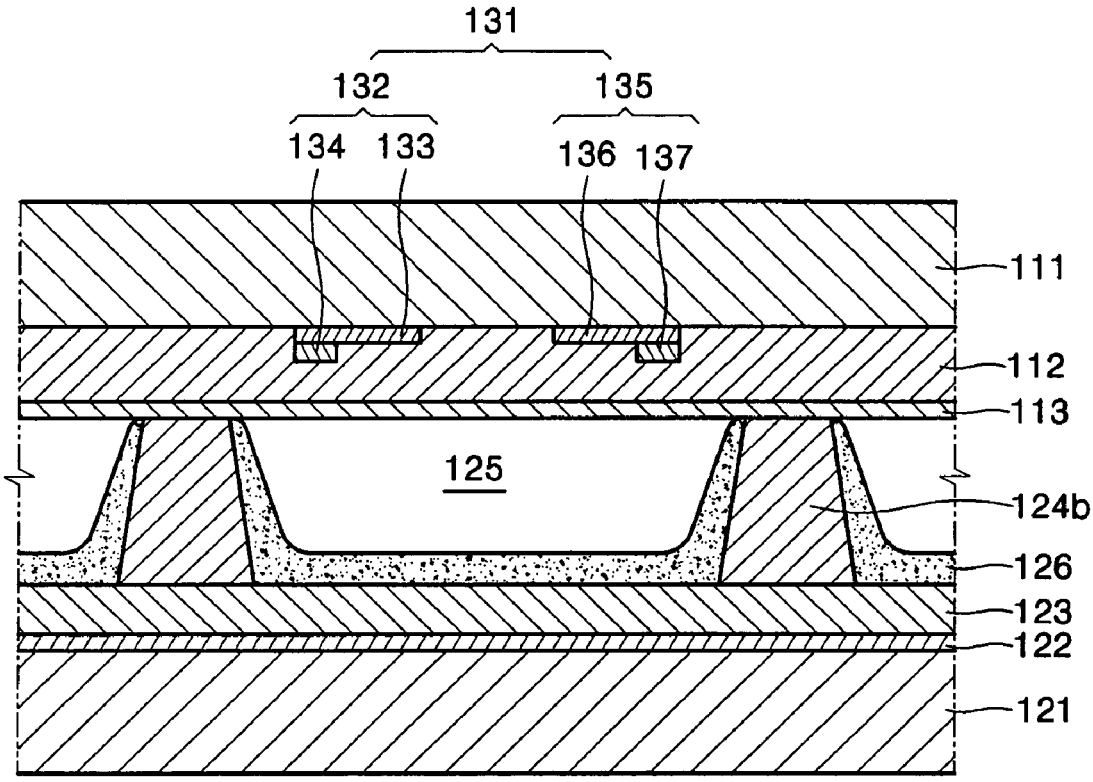
FIG. 5 is a cross-sectional view along line V-V of FIG. 4.

FIG. 4 is a partial perspective view showing a PDP according to an exemplary embodiment of the present invention, and FIG. 5 is a cross-sectional view taken along line V-V of FIG. 4.

Referring to FIG. 4 and FIG. 5, the PDP 100 may include an upper substrate 111 and a lower substrate 121 facing the upper substrate 111.

A plurality of sustain electrode pairs 131 may be arranged on a surface of the upper substrate 111 facing the lower substrate 121. A sustain electrode pair 131 includes an X electrode 132 and a Y electrode 135. The X electrode 132 may act as a common electrode, and the Y electrode 135 may act as a scan electrode.

The X electrode 132 and the Y electrode 135 may include transparent electrodes 133 and 136, and bus electrodes 134 and 137, respectively. The bus electrodes 134 and 137 may be narrower than the transparent electrodes 133 and 136, and they may be formed at edges of the transparent electrodes 133 and 136.

The transparent electrodes 133 and 136 may be formed of a transparent conductive material, such as, for example, indium tin oxide (ITO), so that they may transmit visible light. Additionally, the bus electrodes 134 and 137, which apply voltages to the transparent electrodes 133 and 136, may be formed of a highly conductive metal. As FIG. 4 shows, the transparent electrodes 133 and 136 may have cutouts at portions corresponding to longitudinal barrier ribs 124*a*. However, the transparent electrodes 133 and 136 can be formed in various configurations, such as, for example, as strips having uniform widths.

An upper dielectric layer 112 may cover the sustain electrode pairs 131, and a protective layer 113, which may be made of magnesium oxide (MgO), may cover the upper dielectric layer 112.

Stripe-shaped address electrodes 122 may be formed on a surface of the lower substrate 121 facing the upper substrate 111 and in a direction substantially orthogonal to the sustain electrode pairs 131.

A lower dielectric layer 123 may cover the address electrodes 122, and barrier ribs 124 may be formed on the lower dielectric layer 123 to define predetermined spaces between the upper and lower substrates 111 and 121.

The barrier ribs 124 may include longitudinal barrier ribs 124*a*, which are spaced predetermined distances apart from each other, and transverse barrier ribs 124*b*, which extend perpendicularly from sides of the longitudinal barrier ribs 124*a* to adjacent longitudinal barrier ribs 124*a*. Here, the longitudinal barrier ribs 124*a* are disposed parallel to, and in between, the address electrodes 122.

The longitudinal and transverse barrier ribs 124*a* and 124*b* may form a plurality of closed discharge cells 125 in a matrix pattern, which may prevent cross-talk between adjacent discharge cells 125. Defining the discharge cells 125 in the matrix pattern may also provide a fine pitch and improve brightness and luminous efficiency. The barrier ribs 124 can be formed in other configurations such as, for example, stripes, or delta shapes. The discharge cells 125 generate a sustain discharge to display an image, thus a display area D is formed. Additionally, edges of the PDP without the discharge cells 125 form a terminal area T.

A phosphor material may be applied on side surfaces of the barrier ribs 124 and on the upper surface of the lower dielectric layer 123 to form a phosphor layer 126. A red, green, or blue phosphor layer 126 may be formed in each discharge cell 125 according to the phosphor material's emitting color. Hence, the discharge cells 125 can be classified as red, green, or blue discharge cells 125, and three adjacent red, green, and blue discharge cells form a unit pixel.

Referring to FIG. 5, a sustain electrode pair 131 may be disposed in one discharge cell 125, and the transparent electrodes 133 and 136 have a discharge gap therebetween in the discharge cell 125. Further, the address electrode 122 may be disposed below the discharge cell 125 in a direction substantially perpendicular to the sustain electrode pair 131.

A discharge gas, which may comprise Ne and Xe, is filled in the discharge cells 125 having the above structure. The upper and lower substrates 111 and 121 may then be sealed together by a sealing member, such as a frit glass formed on edges of the upper and lower substrates 111 and 121.

The bus electrodes 134 of the X electrodes 132 extend from the terminal area T to the display area D, as shown in FIG. 4. More specifically, the bus electrode 134 includes a discharge portion 134*a*, which is disposed in the display area D, a terminal portion 134*b*, which is disposed in the terminal area T, and a connection portion 134*c*, which is disposed between the discharge portion 134*a* and the terminal portion 134*b*. Here, the terminal portion 134*b* and the connection portion 134*c* extend from the upper dielectric layer 112 and are disposed in the terminal area T. Additionally, the terminal portion 134*b* and the discharge portion 134*a* may have the same width, and the connection 134*c* may have a uniform width, however, these are not limited thereto. The discharge portion 134*a* is coupled to the transparent electrode 133 to contribute to the discharge, and the terminal portion 134*b* is coupled to a connection member so that the driving voltages can be applied from an X electrode driving unit (not shown) to the X electrode 132.

The connection portion 134*c* connects the terminal portion 134*b* to the discharge portion 134*a* so that the pitch between terminal portions 134*b* can be less than the pitch between discharge portions 134*a*. The pitch between terminal portions 134*b* should be smaller than the pitch between discharge portions 134*a* because a plurality of bus electrodes 134 may be connected to one connection member, and space is provided between connection members to prevent interference between connection members. Additionally, the connection portion 134*c* may be straight when it is located at a center portion of the connection member, however, most of the connection portions 134*c* are slanted at predetermined angles with respect to the discharge portions 134*a* and the terminal portions 134*b*, as FIG. 4 and FIG. 6 show.

The bus electrodes 137 of the Y electrodes 135 extend from the terminal area T to the display area D, and the terminal area T for the Y electrodes may be on an opposite side of the PDP from the terminal area T for the bus electrodes 134 of the X electrodes 132. Referring to FIG. 6, the bus electrodes 137 may include a discharge portion 137*a*, which is disposed in the display area D, a terminal portion 137*b*, which is disposed in the terminal area T, and a connection portion 137*c*, which is disposed between the discharge portion 137*a* and the terminal portion 137*b*. Here, the terminal portion 137*b* and the connection portion 137*c* extend from the upper dielectric layer 112 and are disposed in the terminal area T. Further, the terminal portion 137*b* and the discharge portion 137*a* may have the same width, and the connection portion 137*c* may have a uniform width. The discharge portion 137*a* is coupled to the transparent electrode 136 to contribute to the discharge, and the terminal portion 137*b* is coupled to a connection member so that a Y electrode driving unit (not shown) can apply voltages to the Y electrodes 135. The connection portion 137*c* connects the terminal portion 137*b* and the discharge portion 137*a* so that the pitch between terminal portions 137*b* can be less than the pitch between discharge portions 137*a*.

Figure 6:
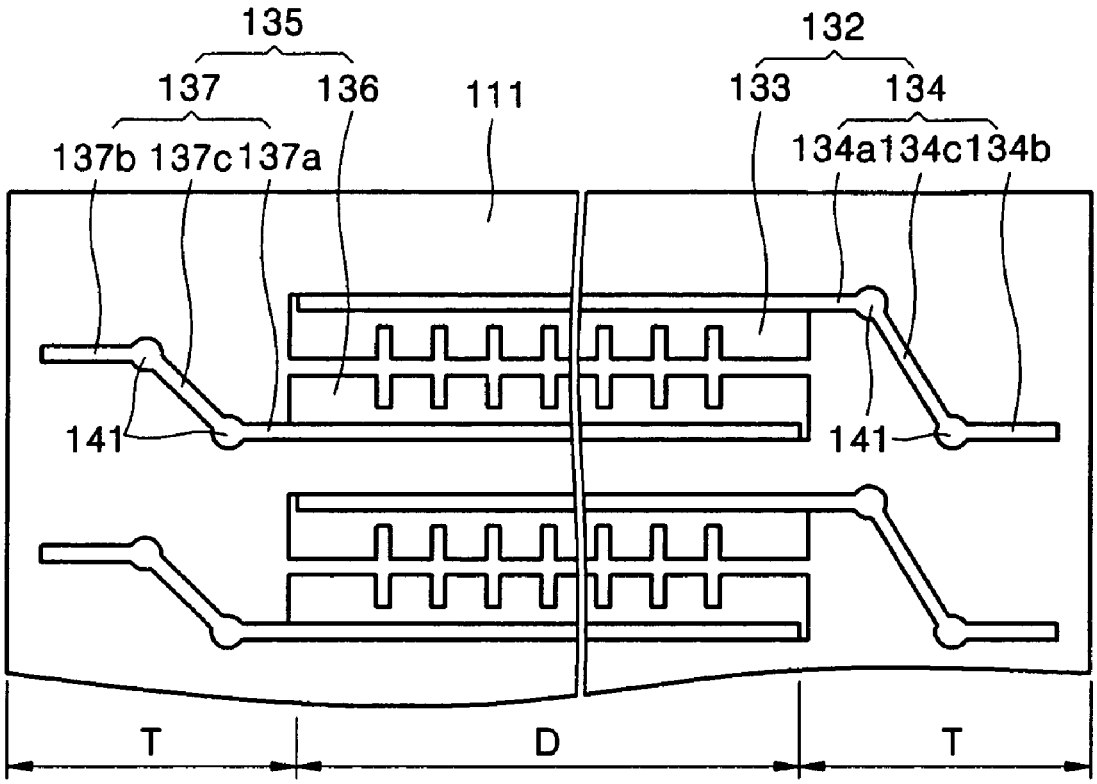
FIG. 6 is a plan view showing sustain electrode pairs of FIG. 4.

Referring to FIG. 6, in the bus electrodes 134 and 137 having the above structures, expansion portions 141 join the connection portions 134*c* and 137*c* and the discharge portions 134*a* and 137*a* together, and the connection portions 134*c* and 137*c* and the terminal portions 134*b* and 137*b* together. While the expansion portions 141 are shown joining the slanted type connection portions 134*c* and 137*c*, the expansion portion 141 can also be formed to join the straight type connection portion to the other portions of the bus electrode.

The expansion portion 141 increases the area of the bus electrodes 134 and 137 at the junctures of the connection portions 134*c* and 137*c* and the discharge and terminal portions 134*b*, 137*b*, 134*a*, 137*a*, thus increasing the bus electrodes' adhesion with the upper substrate 111. The expansion portions 141 are wider than the connection portions 134*c* and 137*c*, the discharge portions 134*a* and 137*a*, and the terminal portions 134*b* and 137*b*. Thus, the area of the bus electrodes 134 and 137 can increase at the junctures. Moreover, the expansion portions 141 may have curved edges. Hence, when baking the bus electrodes 134 and 137 at a high temperature, the heat can be better distributed to the entire bus electrodes 134 and 137, which may improve the bus electrodes' adhesion to the upper substrate 111. Therefore, the junctures of the connection portions 134*c* and 137*c* and the discharge portions 134*a* and 137*a*, and the junctures of the connection portions 134*c* and 137*c* and the terminal portions 134*b* and 137*b*, may not detach and be cut off. Accordingly, the shorts with the connection portions 134*c* and 137*c* or the terminal portions 134*b* and 137*b* of adjacent bus electrodes 134 and 137 may be prevented.

The bus electrodes 134 and 137 may each include a black electrode layer and a white electrode layer formed on the black electrode layer. The black electrode layer may be formed of, for example, Ru, Co, or Mn, which have black color to absorb external light and improve bright room contrast. The white electrode layer may be formed of, for example, Ag, Al, or Au, which have white color to complement the less conductive black electrode layer. Here, the black electrode layer may be disposed close to the upper substrate 111 in order to improve its ability to absorb external light. While the bus electrodes 134 and 137 may be formed through development and baking processes, since the bus electrodes 134 and 137 are formed using two different kinds of metal, the developing process may undercut the black electrode layers. Further, since the white electrode layers may be extracted during the baking process, the adhesive forces of the terminal portions 134*b* and 137*b* and the connection portions 134*c* and 137*c* may become weak. In this case, if the expansion portions 141 increase the areas of the bus electrodes 134 and 137 at the junctures of the connection portions 134*c* and 137*c* and the discharge portions 134*a* and 137*a*, and at the junctures of the connection portions 134*c* and 137*c* and the terminal portions 134*b* and 137*b*, according to the present invention, the connection portions 134*c* and 137*c* and the terminal portions 134*b* and 137*b* may be more firmly adhered to the upper substrate 111.

Figure 7:
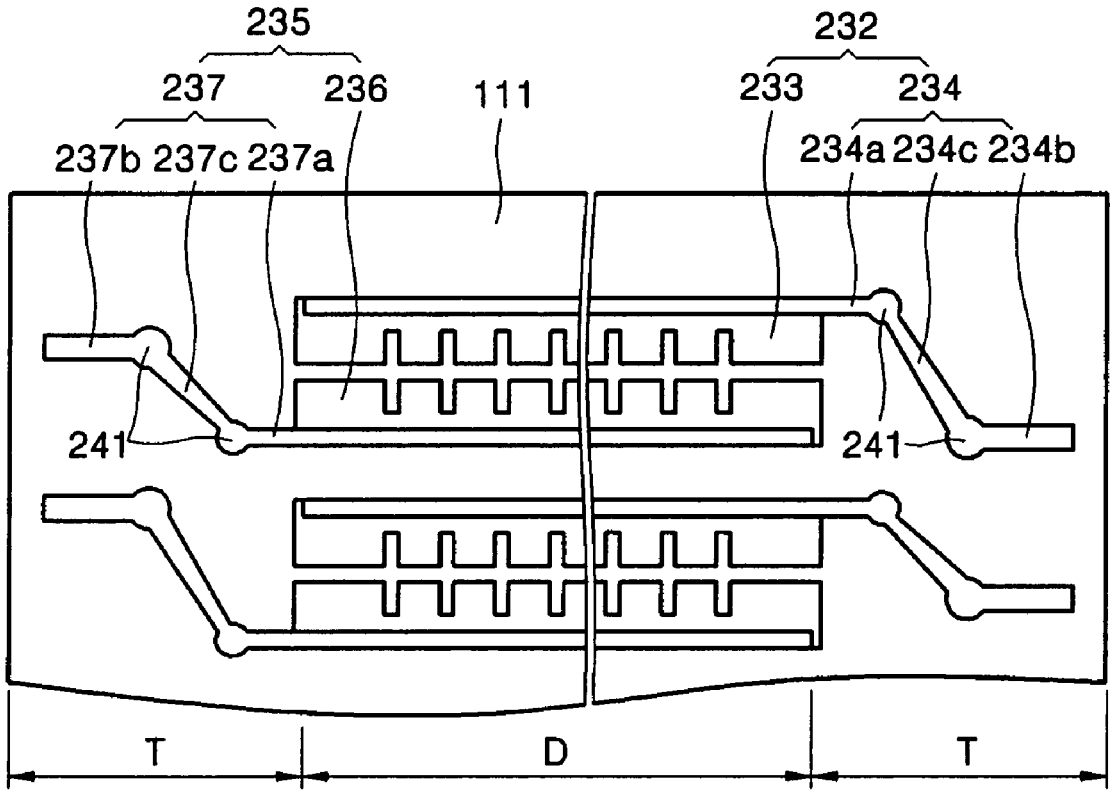
FIG. 7 is a plan view showing another example of the sustain electrode pairs of FIG. 4.

FIG. 7 is a plan view showing sustain electrode pairs according to another exemplary embodiment of the present invention. Referring to FIG. 7, comparing bus electrodes 234 and 237 of the X and Y electrodes 232 and 235, respectively, to the bus electrodes 134 and 137 of FIG. 6, the terminal portions 234*b* and 237*b* are wider than the discharge portions 234*a* and 237*a*, to which transparent electrodes 233 and 236 are coupled. Accordingly, the slanted type connection portions 234*c* and 237*c* may gradually widen from the discharge portions 234*a* and 237*a* toward the terminal portions 234*b* and 237*b*. Additionally, the expansion portions 241 joining the connection portions 234*c* and 237*c* and the discharge portions 234*a* and 237*a* may be smaller than the expansion portions 241 joining the connection portions 234*c* and 237*c* and the terminal portions 234*b* and 237*b*. Consequently, areas of the slanted type connection portions 234*c* and 237*c* and the terminal portions 234*b* and 237*b* may increase, which may improve the bus electrodes' adhesion to the upper substrate 111. Additionally, expansion portions 241 may be formed at junctures of the connection portions 234*c* and 237*c* and the discharge portions 234*a* and 237*a*, and junctures of the connection portions 234*c* and 237*c* and the terminal portions 234*b* and 237*b*, to increase the attaching area of the bus electrodes 234 and 237. As described above, the expansion portions 241 may be wider than the discharge portions 234*a* and 237*a*, the terminal portions 234*b* and 237*b*, and the connection portions 234*c* and 237*c*. Furthermore, the expansion portions 241 may have curved edges.

As described above, according to exemplary embodiments of the present invention, a bus electrode expansion portion may be formed at the juncture of the connection portion and the discharge portion, and the juncture of the connection portion and the terminal portion, to increase the bus electrode's attaching area. Thus, the bus electrode may be more firmly adhered to the upper substrate. Additionally, even if the bus electrodes include a black is electrode layer, the expansion portions may improve the bus electrodes' adhesion to the upper substrate.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

an upper substrate;

a lower substrate coupled to the upper substrate to form a display area for displaying an image and a terminal area; and a plurality of electrodes, an electrode including a discharge portion disposed in the display area, a terminal portion disposed in the terminal area, a connection portion coupling the discharge portion with the terminal portion, a first expansion portion, and a second expansion portion, wherein the first expansion portion is formed at a juncture of the connection portion and the discharge portion, and the second expansion portion is formed at a juncture of the connection portion and the terminal portion, the first expansion portion being wider than the connection portion and the discharge portion, and the second expansion portion being wider than the connection portion and the terminal portion.

2. The PDP of claim 1, wherein the connection portion is slanted with respect to the discharge portion and the terminal portion.

3. The PDP of claim 2, wherein the first expansion portion and the second expansion portion have curved edges.

4. The PDP of claim 2, wherein the discharge portion and the terminal portion have the same widths as each other, and the connection portion has a uniform width.

5. The PDP of claim 2, wherein the terminal portion is wider than the discharge portion, and the connection portion gradually widens from the discharge portion to the terminal portion.

6. The PDP of claim 5, wherein the first expansion portion is smaller than the second expansion portion.

7. A plasma display panel (PDP), comprising:

a lower substrate;

address electrodes formed on an upper surface of the lower substrate and covered by a lower dielectric layer;

an upper substrate facing the lower substrate;

barrier ribs formed between the lower substrate and the upper substrate to define discharge cells forming a display area; and sustain electrodes formed on a lower surface of the upper substrate and extending in a direction crossing the address electrodes, a sustain electrode including a bus electrode having a discharge portion disposed in the display area and covered by an upper dielectric layer, a terminal portion disposed outside of the display area, a connection portion coupling the discharge portion with the terminal portion, a first expansion portion, and a second expansion portion, wherein the first expansion portion is formed at a juncture of the connection portion and the discharge portion, and the second expansion portion is formed at a juncture of the connection portion and the terminal portion, the first expansion portion being wider than the connection portion and the discharge portion, and the second expansion portion being wider than the connection portion and the terminal portion.

8. The PDP of claim 7, wherein the connection portion is slanted with respect to the discharge portion and the terminal portion.

9. The PDP of claim 8, wherein the first expansion portion and the second expansion portion have curved edges.

10. The PDP of claim 8, wherein the discharge portion and the terminal portion have the same widths as each other, and the connection portion has a uniform width.

11. The PDP of claim 8, wherein the terminal portion is wider than the discharge portion, and the connection portion gradually widens from the discharge portion to the terminal portion.

12. The PDP of claim 11, wherein the first expansion portion is smaller than the second expansion portion.

13. The PDP of claim 7, wherein the bus electrode comprises a black electrode layer and a white electrode layer formed on the black electrode layer.

14. The PDP of claim 7, wherein the sustain electrode further includes a transparent electrode coupled to the bus electrode.

15. The PDP of claim 14, wherein the sustain electrodes are formed in pairs, and a pair of sustain electrodes is disposed at each discharge cell.

16. The PDP of claim 7, further comprising a protective layer covering the upper dielectric layer.

* * * * *

UNITED STATES PATENT AND TRADEMARK OFFICE

CERTIFICATE OF CORRECTION

PATENT NO. : 7,573,196 B2
APPLICATION NO. : 11/135388
DATED : August 11, 2009
INVENTOR(S) : Kwon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 903 days.

Signed and Sealed this

Seventh Day of September, 2010

David J. Kappos

David J. Kappos
*Director of the United States Patent and Trademark Office*